United States Patent [19]

Wachspress et al.

[11] Patent Number: 4,520,363

[45] Date of Patent: May 28, 1985

[54] OMNIDIRECTIONAL VERTICAL ANTENNA WITH IMPROVED HIGH-ANGLE COVERAGE

[75] Inventors: Melvin H. Wachspress, Syosset; Walter Abramowitz, Jamaica, both of N.Y.

[73] Assignee: General Instrument Corporation, New York, N.Y.

[21] Appl. No.: 475,921

[22] Filed: Mar. 16, 1983

[51] Int. Cl.[3] ..... H01Q 1/36

[52] U.S. Cl. ..... 343/828; 343/830; 343/908

[58] Field of Search ..... 343/828, 829, 830, 831, 343/899, 908

[56] References Cited

U.S. PATENT DOCUMENTS

| | | | |
|---|---|---|---|
| 2,351,723 | 1/1944 | Vogel | 343/899 |
| 2,724,052 | 11/1955 | Boyer | 343/830 |
| 3,967,276 | 6/1976 | Goubau | 343/828 |
| 4,342,037 | 7/1982 | Dalby | 343/830 |

*Primary Examiner*—Eli Lieberman

*Attorney, Agent, or Firm*—Hopgood, Calimafde, Kalil, Blaustein & Judlowe

[57] ABSTRACT

An antenna structure includes a radiator element secured at one end to a ground plane. Two conducting plates separated by an axial spacer are secured to the opposite end of the radiator element.

5 Claims, 4 Drawing Figures

OMNIDIRECTIONAL VERTICAL ANTENNA WITH IMPROVED HIGH-ANGLE COVERAGE

The present invention relates generally to antennas, and more particularly to an antenna having a more uniform radiation pattern.

Antennas are in common use in a wide variety of applications, both commercial and military, both to transmit and to receive signals. Typical uses of antennas are in data communications, radar, and navigation and guidance systems. The selection of a particular antenna configuration for a particular use is based, in large part, upon the radiation pattern produced by the antenna.

It is often desirable, such as in airport guidance systems and in radar decoys, for the antenna to produce linear, vertically polarized radiation, and an omnidirectional or hemispherical radiation pattern that extends to high radiation angles so as to enable the antenna to receive incoming signals from near or directly above the antenna. This type of radiation pattern cannot be achieved in many antennas as a result of the circular symmetry of the antenna, which causes the horizontal components of the E vector, which are necessary for high-angle radiation, to tend to cancel out. This results in a broad null about the vertical axis and a sharp decrease in the radiation pattern, particularly at high radiation angles between 0° and 20°.

One known antenna design is an inverted conical monopole, which is described in the December 1952 issue of the RCA Review. This antenna has proven to be effective in many applications, but its radiation pattern exhibits a marked falloff at high angles. The inclusion of a finite ground plane at the lower narrow end of the conical structure has been found to help fill in the horizontal pattern for this antenna, but the resulting high-angle pattern even with the inclusion of a ground plane remains unsuitable for many applications.

It is thus an object of the present invention to provide an antenna having an improved radiation pattern.

It is another object of the invention to provide an antenna having improved high-angle coverage.

It is a further object of the present invention to provide an antenna that produces a substantially hemispheric radiation pattern that extends to high radiation angles.

The antenna of the invention includes a conducting radiator on which are mounted a pair of axially spaced conducting discs. The antenna provides improved, more nearly uniform and high-angle, hemispheric coverage, thereby to permit the antenna to receive signals from more directly above the antenna.

To the accomplishment of the above and such further objects as may hereinafter appear, the present invention relates to an improved antenna structure, substantially as defined in the appended claims and as described in the following specification as considered in conjunction with the accompanying drawings, in which:

Figure 1:
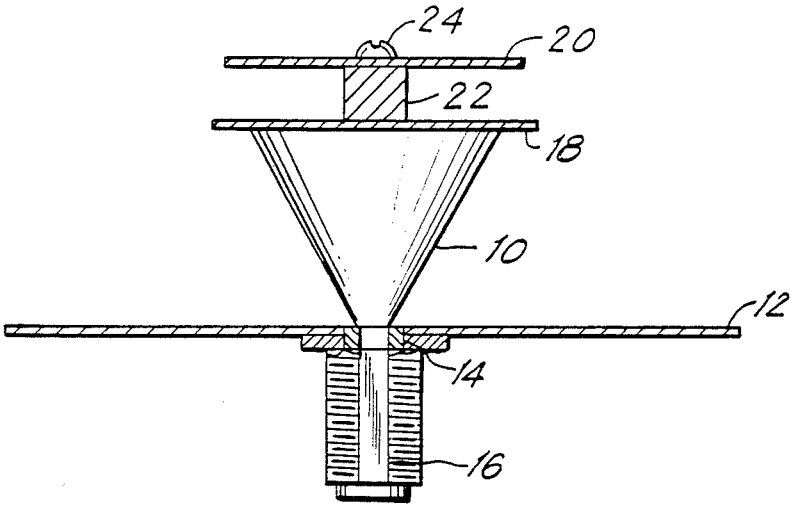
FIG. 1 is an elevation of an antenna according to an embodiment of the invention.
Figure 2:
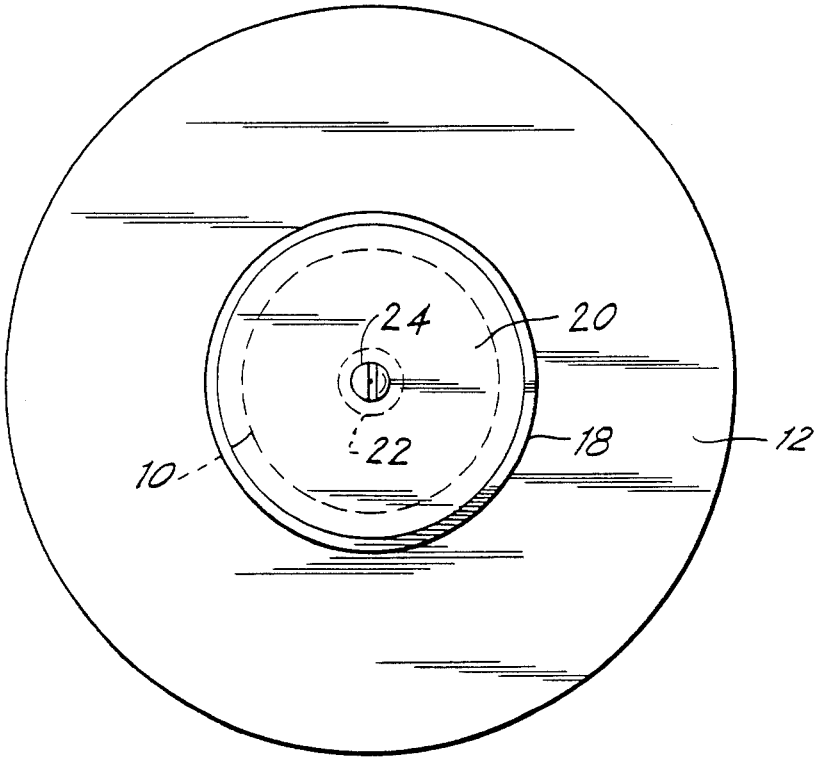
FIG. 2 is a plan view of the antenna of FIG. 1.

The antenna of the invention, in accordance with the embodiment thereof illustrated in FIGS. 1 and 2, includes a radiator element, here shown in the form of inverted conical monopole 10, which may be made of any conducting material such as copper or brass. The lower, narrow end of conical radiating member 10 may, as shown, be secured to a conducting ground plane 12, which is secured by means of a bushing 14 to a type N connector 16 by means of which the antenna is connected to an external receiver or transmitter.

In accordance with the invention, a conducting metal disc 18 is secured to the opposite or relatively wide upper end of conical member 10, and a second conducting metal disc 20 is mounted on and secured to the upper end of a metal conducting spacer 22 by means such as a screw 24. The lower end of spacer 22 is secured to disc 18, and thus serves to provide a fixed axial spacing between the two conducting discs 18 and 20 and to arrange the axes of the two discs along the vertical axis of the conical member 10. As shown in FIGS. 1 and 2, the diameter of disc 18 is greater than that of disc 20, and the diameters of both discs 18 and 20 are greater than the largest diameter of conical member 10, but less than that of the ground plane 12. In an antenna that has been constructed according to the arrangement of FIG. 1, the length of the axial spacer 22 was about one-sixth the diameter of disc 18 and one-fifth the diameter of disc 20. The diameter of spacer 22 was about one-fifth that of disc 18, and the diameter of ground plane 12 was more than twice that of disc 18.

Figure 3:
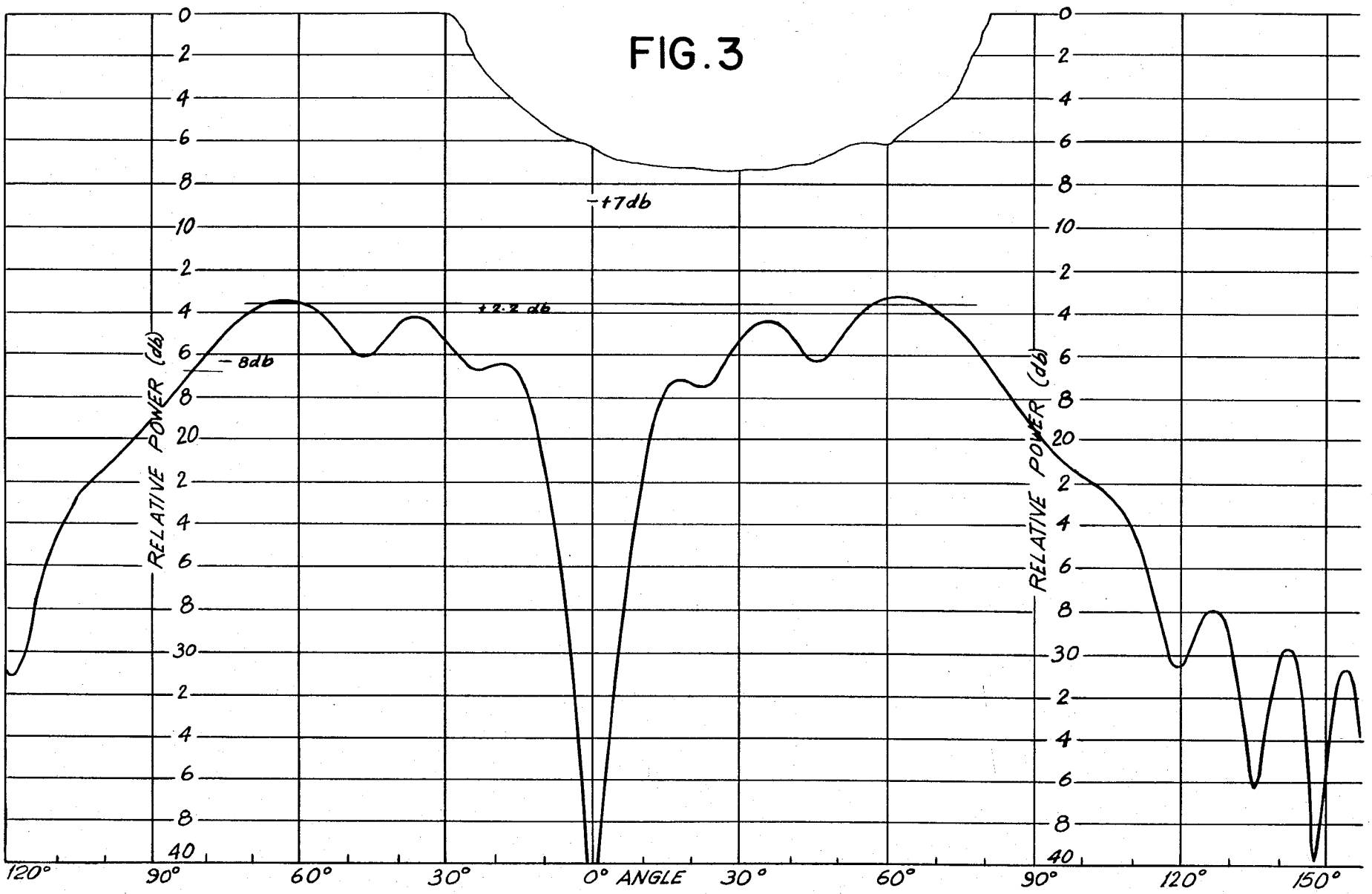
FIG. 3 is a radiation pattern of a conventional antenna.
Figure 4:
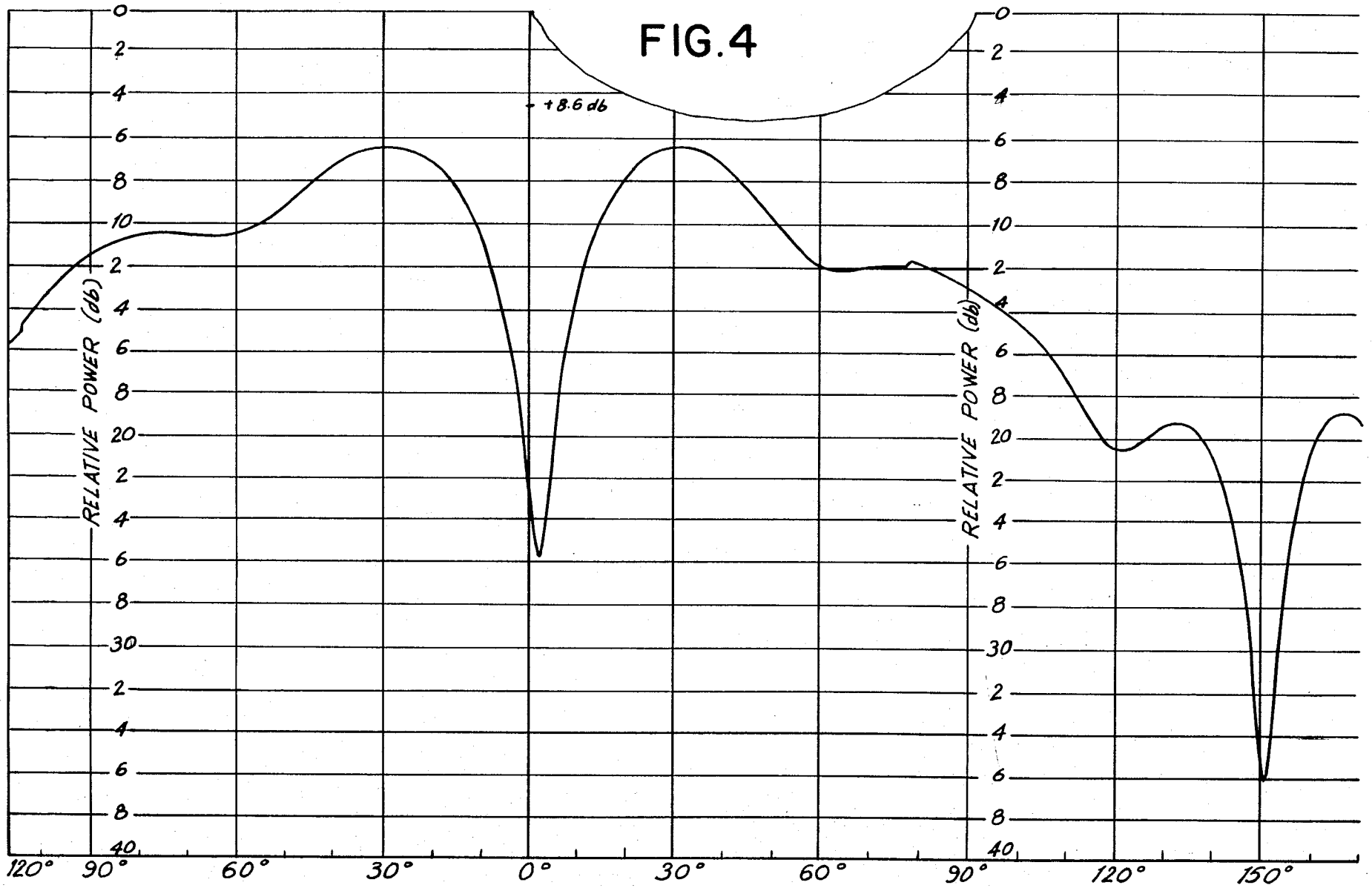
FIG. 4 is a radiation pattern of the antenna of the invention.

It has been found that the provision of the axially spaced discs 18 and 20 in the manner described above produces an unexpectedly uniform radiation pattern, particularly one with an improved uniform high-angle coverage, which permits the antenna to more effectively receive signals from directly above the antenna. This improvement in the high-angle radiation pattern attained in the antenna of the invention can be readily seen by a comparison of FIG. 3, which is a radiation pattern of a conventional conical monopole antenna, and FIG. 4, which is a radiation pattern of an antenna according to the invention and having the configuration of FIGS. 1 and 2. The measurements for the radiation patterns of both FIGS. 3 and 4 were taken for signals at a frequency of 5.5 GHz. More particularly, FIG. 4 illustrates the increased antenna coverage of high-angle signals between 0° and 30°, as well as the more nearly hemispherical and omnidirectional pattern that is achieved by the antenna of the invention as compared to that achieved by the conventional antenna.

It will thus be appreciated that the antenna of the present invention provides an improved radiation pattern by which improved reception of signals at high angles can be achieved. It will be also understood that although the antenna has been hereinabove described with respect to a single embodiment in which the radiation member is in the form of a conical monopole, variations and modifications may be made thereto, such as the use of other types of radiation members, without necessarily departing from the spirit and scope of the invention.

What is claimed is:

1. An antenna structure comprising an inverted conical monopole, a ground plane secured to one end of said monopole, a first conducting plate having a diameter greater than that of the largest diameter of said monopole secured to the other end of said monopole, a second conducting plate, and a spacer interposed between and secured to said first and second plates and axially aligned therewith and with said monopole.

2. The antenna structure of claim 1, in which the diameter of said second plate is less than that of said first plate, but greater than the largest diameter of said conical monopole.

3. The antenna structure of claim 2, in which the diameters of said first and second plates are both less than that of said ground plane.

4. An antenna arrangement comprising an inverted conical monopole, a first disc connected to the wider-diameter end of said monopole and having a diameter greater than that of the wider-diameter end of said conical monopole, a second disc, and a spacer interposed between and secured to said first and second discs, said first and second discs and said spacer being coaxial with the vertical axis of said conical monopole.

5. The antenna structure of claim 4, in which the diameter of said second disc is less than that of said first disc, but greater than the largest diameter of said conical monopole.

* * * * *